United States Patent [19]

Schmidt

[11] Patent Number: 4,554,958

[45] Date of Patent: Nov. 26, 1985

[54] APPARATUS FOR ROUNDING THE CIRCUMFERENCE OF A LOG

[75] Inventor: Charles J. Schmidt, Diboll, Tex.

[73] Assignee: Arthur Temple, III, Austin, Tex. ; a part interest

[21] Appl. No.: 611,250

[22] Filed: May 17, 1984

[51] Int. Cl.[4] ..... B27L 1/00; B27C 9/04

[52] U.S. Cl. ..... 144/4; 144/3 R; 144/208 G; 144/242 C; 144/246 C; 144/365; 198/383; 198/624; 414/432

[58] Field of Search ..... 414/432; 198/383, 624, 198/786; 144/3 R, 208 R, 208 G, 209 R, 211, 212, 213, 242 R, 242 C, 365, 367, 380, 246 C

[56] References Cited

U.S. PATENT DOCUMENTS 4,335,764 6/1982 Schmidt .

FOREIGN PATENT DOCUMENTS 2332608 1/1975 Fed. Rep. of Germany ..... 198/383

2816728 10/1978 Fed. Rep. of Germany ... 144/208 G

*Primary Examiner*—W. D. Bray

*Attorney, Agent, or Firm*—Fulbright & Jaworski

[57] ABSTRACT

An apparatus for rounding the circumference of a wood log which is supported by two sets of three drive rollers at spaced points between the ends of the log to establish a geometrical center. A knife is positioned extending the length of the log for cutting off a portion of the log for rounding the circumference of the log. The lower rollers are connected together through a shock absorber to accommodate varying diameters and one roller of each set is connected together by a torsion bar. One of the lower rollers of each set is positioned upwardly relative to the other lower roller an amount for allowing the apparatus to provide a maximum yield from different diameter logs. The rollers are of a plurality of self-cleaning, rotatable drive discs. The apparatus may include debarking arms. And the apparatus may sort the rounded up logs by diameter size.

17 Claims, 12 Drawing Figures

APPARATUS FOR ROUNDING THE CIRCUMFERENCE OF A LOG

BACKGROUND OF THE INVENTION

Wood logs or blocks are used for various purposes in the wood industry. It is desirable in many applications that the logs have a round or circular circumference. For example, in conventional veneer lathes or in the centerless veneer lathe described in U.S. Pat. No. 4,335,764, the logs or blocks being used for veneer have to be debarked and rounded up before being made into veneer sheets. Rounding up also saves conveying excess and undesirable weight, time and energy to treat the undesired excess, and results in increased production and conserves energy in various phases of the wood industry.

The present apparatus is directed to removing protruding portions of a wood log from its outer circumference such as bent and out-of-round logs, and protrusions or humps from the outer circumference to provide a wood log having a rounded up circumference.

SUMMARY

The present invention is directed to an apparatus for rounding up or rounding the circumference of wood logs or blocks along the full length of the logs.

Still a further object of the present invention is the provision of a round up apparatus having means for debarking the full length of the log prior to rounding up.

Still a further object of the present invention is the provision of a round up machine having means for sorting the rounded up logs in accordance with the size of their diameter.

Still a further object of the present invention is the provision of an apparatus for rounding up the circumference of a wood log having first and second spaced rotatable rollers adapted to engage the outside of a wood log at two spaced points between the ends of the log. A knife is positioned adjacent the first and second rollers and extends the length of the log for cutting off an amount of material from the outer circumference of the log for making the outer circumference of the log more uniformly round. Third and fourth movable rollers are positioned below the first roller and movable away from the first roller and each other. Fifth and sixth movable rollers are positioned below the second roller and are movable towards and away from the second roller and each other. Power means rotate the rollers and a log positioned between the rollers allowing the knife to cut off portions of the log for rounding the circumference of the log or reducing its diameter.

Yet a further object of the present invention is wherein the third and fourth movable rollers are connected together and move together through a shock absorber and the fifth and sixth movable rollers are connected together and move together through a shock absorber allowing the spaced rollers to accommodate different diameters at the spaced rollers.

Still a further object of the present invention is wherein the third and fifth rollers are connected together by a torsion bar for synchronizing the operation of the sets of rollers at the two spaced points.

Yet a still further object of the present invention is wherein the third and fifth rollers move upwardly a distance towards the first and second rollers, respectively, greater than the fourth and sixth rollers for geometrically positioning various diameter logs for maximizing the yield from various sized logs. The position of the rollers is such that a log, regardless of its size, is brought to a common tangent where the knife makes contact, the tangent point is substantially the same position for various sized logs.

Still a further object of the present invention is the provision of a self-cleaning, drive roller which includes on its outer periphery a plurality of openings extending radially inwardly and outwardly to a side of the disc for shedding debris.

Yet a further object of the present invention is wherein the bottom of the openings extends downwardly and outwardly for compressing and expelling debris.

A further object is wherein the drive roller may include a plurality of rotatable drive discs spaced apart and scraper means such as a fixed cable is positioned between adjacent discs and extends outside of the disc for cleaning debris from between the discs.

Still a further improvement in the self-cleaning disc is wherein one plurality of openings on the outer periphery extends inwardly and outwardly to one side of the disc and another plurality of openings extend inwardly and outwardly to the other side of the disc leaving a wavy surface that produces good traction with smoothness.

Another object of the present invention is the provision of measuring the diameter of the rounded up logs and sorting the rounded up logs in accordance with their diameter size.

Yet a still further object of the present inveniton is the provision of a plurality of debarking arms positioned to engage and debark a log rotated by the rollers prior to or during rounding up the circumference of the log.

Other and further features, objects and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
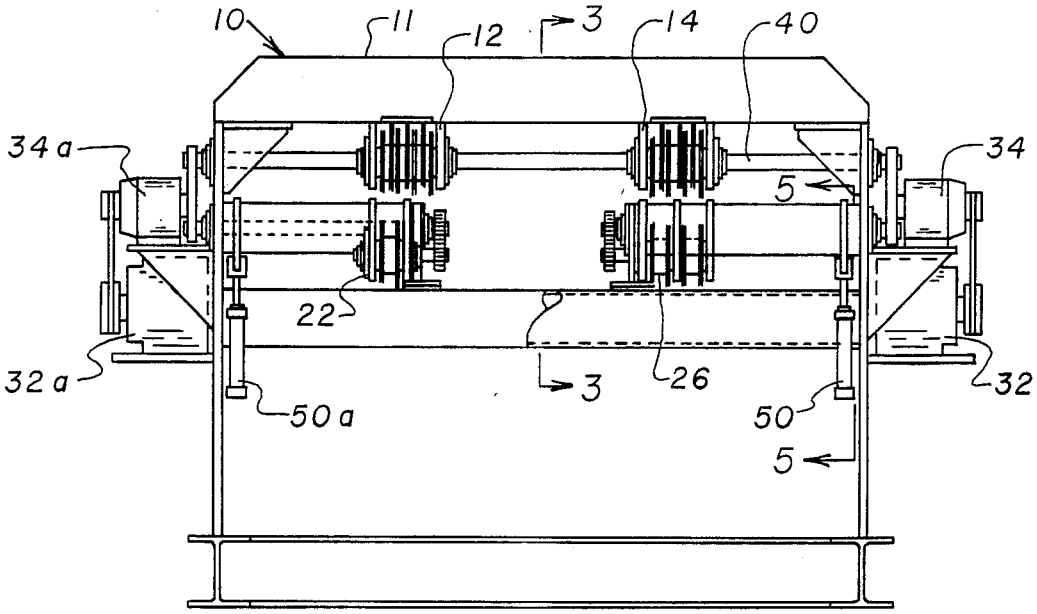
FIG. 1 is an elevational view of the round up machine of the present invention.
Figure 3:
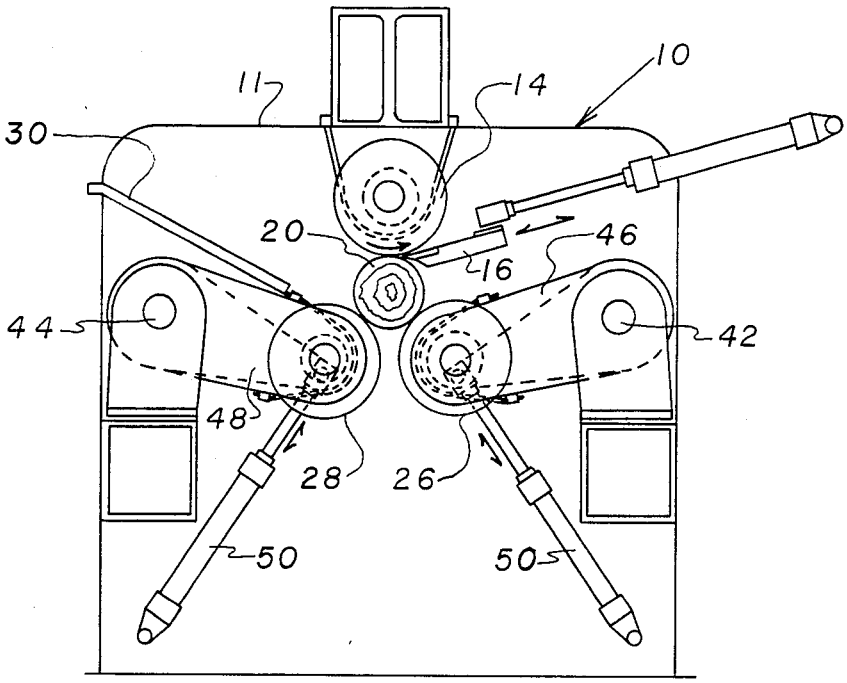
FIG. 3 is an enlarged cross-sectional view taken alone line 3—3 of FIG. 1 shown rounding up the circumference of a log.

Referring now to the drawings, and particularly to FIGS. 1 and 3, the reference numeral 10 generally indicates the round up machine of the present invention and generally includes a frame 11 and two sets of rollers 12 and 14 at spaced apart positions supported from the frame 11 for engaging the outside of a wood log at two spaced points between the ends of the log. Thus, a first 12 and a second 14 fixed rotatable roller are spaced from each other and are adapted to engage the outside of a wood log 20 at two spaced points. Preferably, each roller is positioned approximately one-fourth the length of the log from one end of the log. A movable knife 16 is positioned adjacent to the first and second rollers 12 and 14 and extends the length of a log 20 and is positioned in the apparatus 10 for cutting off an amount of material from the outer circumference of the log for making the outer circumference of the log more uniformly round or reducing the diameter.

Third and fourth movable rollers 22 and 24 are positioned below the first fixed roller 12 and are movable towards away and from the first roller 12 and each other. Similarly, fifth and sixth movable rollers 26 and 28 are positioned below the second fixed roller 14 and are movable towards and away from the second roller 14 and each other.

A log loading ramp 30 is provided (FIG. 3) for feeding logs into the apparatus 10. Basically, the lower rollers 22 and 24 and 26 and 28 are retracted downwardly into a lower position that creates a receiving pocket to receive and hold a log that is fed down the loading ramp 30. After the log is in the pocket, all of the lower rollers 22, 24, 26 and 28 are raised to bring the log 20 into contact with the upper rollers 12 and 14. Thus, the log 20 is then geometrically centered by its longitudinal axis between the first set of rollers 12, 22 and 24 and the second set of rollers 14, 26 and 28. All of the rollers are then driven to rotate the log 20, and the knife 16 is fed into the log 20 to remove a sufficient amount of material from the outer circumference of the log 20 for making the outer circumference of the log more uniformly round and leaving the log 20 in a rounded up condition about its longitudinal axis. After the log 20 has been rounded up, the knife 16 is retracted, the lower rollers 22, 24 and 26 and 28 are lowered to a position that allows the rounded up log 20 to pass between them and out of the bottom of the apparatus 10. At this time the lower rollers 22, 24, 26 and 28 are raised back into a receiving position and await another log 20 to be fed into the ramp 30 and the next cycle begins.

Figure 2:
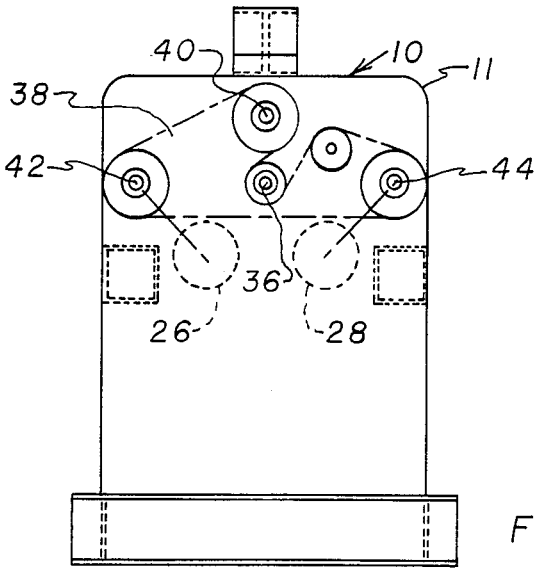
FIG. 2 is an end elevation of the round up machine of FIG. 1 showing the power drive train.

Referring now to FIGS. 1 and 2, a suitable drive mechanism is shown at one or both ends of the frame 11 for driving the rollers. Thus, a prime mover 32 at one end of the frame 11 drives a gear box 34 which in turn drives an output shaft 36 and chain drive 38. The chain drive 38 in turn drives an upper roll drive shaft 40 for driving the upper rollers 12 and 14 and lower roller drive shafts 42 and 44. As best seen in FIG. 3, lower drive shafts 42 and 44 in turn drive lower rollers 26 and 28, respectively, through pivot arms 46 and 48, respectively, and chain drives. The drive rollers 26 and 28 are raised and lowered by a hydraulic piston and cylinder assembly 50. The second end of the frame 11 may have a similar driving arrangement by having a motor 32*a*, a gear box 34*a* which also is connected to and drives the upper drive shaft 40 and lower drive shafts for rotating the lower rollers 22 and 24. Similarly, pistons 50*a* are provided at the second end for raising and lowering the rollers 22 and 24.

Figure 5:
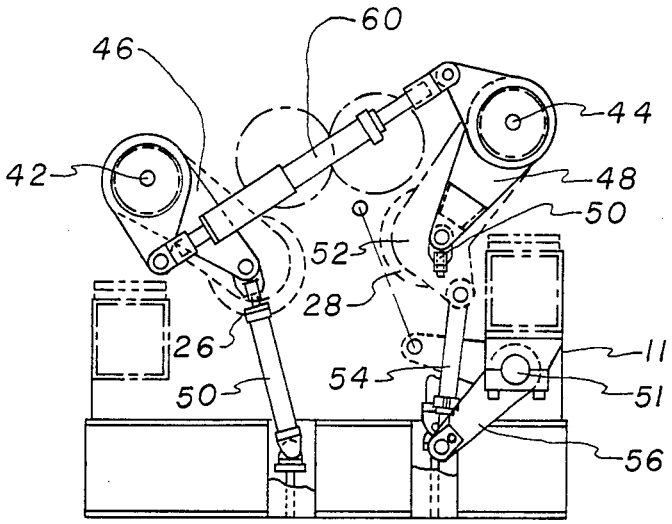
FIG. 5 is a cross-sectional view taken along the line 5–5 of FIG. 1 illustrating the interconnection between the movable rollers.

However, while the top two fixed rollers 12 and 14 operate on the same drive shaft and therefore are in synchronism, it is also desirable to keep the other movable rollers 22, 24, 26 and 28 in synchronism and timing while at the same time allowing them to accommodate logs 20 in which the diameter at either end may be different. Referring now to FIG. 5, showing connections at one end of the apparatus 10, the pistons 50 raise and lower the rollers 28 and 30. However, in order to synchronize the movable rollers of the two sets, a torsion bar 51 is supported from the frame 11 and connected between the movable roller 28 of one set and the movable roller 24 of the second set. Thus, roller 28 by an arm 52 is connected to an adjustable linkage 54 which in turn is connected to a torsion bar linkage arm 56 connected to the torsion bar 51. The second roller 24 of the other set is similarly connected to a similar linkage to the torsion bar 51. Thus, the rollers 28 and 24 will move and rotate in synchronism. By positioning the torsion bar 51 opposite from the knife 16, connecting rollers 28 and 24, the side of the log 20 opposite from the knife 16 will be parallel the knife 16. Therefore the apparatus 10 will tend to remove more wood from the large end of the log 20 thereby resulting in a log with less taper. The rollers 28 and 24 could be placed on a common shaft with a common pivot, but the present arrangement facilitates making the drive drive simpler and is easily adjustable.

The rollers 26 and 28 will also rotate in synchronism by virtue of being connected together through a hydraulic spring shock absorber 60. The rollers 22 and 24 are similarly connected together by a hydraulic spring shock absorber. Since the diameter of the log 20 encountered by the rollers 26 and 28 may differ from the diameter of the same log 20 encountered by the rollers 22 and 24, a hydraulic spring shock absorber 60 at each end allows the rollers to engage and drive the log and compensate for different size diameter of the log 20 at opposite ends.

Figure 6:
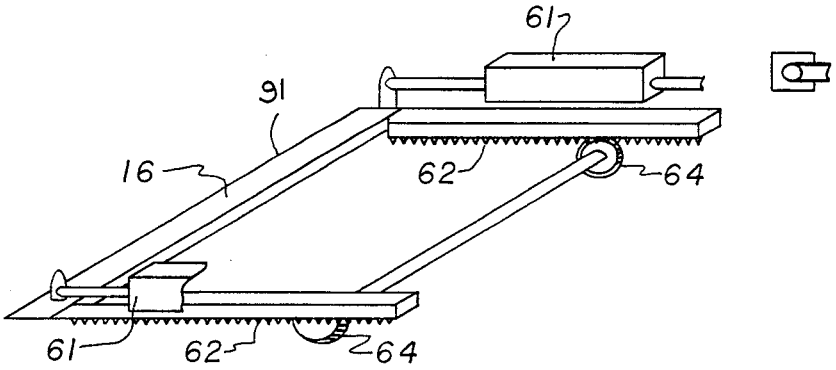
FIG. 6 is a perspective elevational view illustrating the drive system for the knife used in the present invention.

Referring now to FIG. 6, the knife 16 is illustrated which extends the entire length of the log 20, and is adapted to be retracted away and moved towards the log 20 by a hydraulic piston and cylinder assembly 61 at each end. The knife 16 may also move forward and backwards and be timed by or kept in synchronism by a rack 62 and pinion 64 arrangement on either end of the knife 16.

Figure 4:
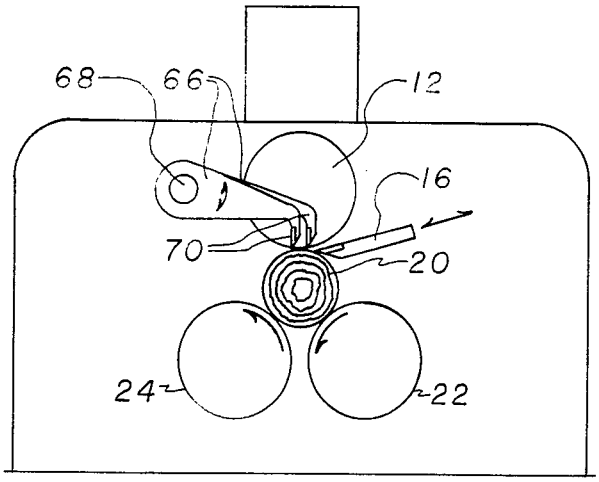
FIG. 4 is a cross-sectional view, schematically showing the debarking and round up operation on a log by the present invention.

Referring now to FIG. 4, a plurality of debarking arms 66, on both sides of the rollers 12 and 14, may be provided about a pivot 68 having fingers 70 for engaging and debarking a log 20 prior to and during the round up operation. This is advantageous as removing the bark by the fingers 70 allows the knife to be saved for rounding up and prevents it from getting prematurely dull. The rollers act between the debarking arms 66 to remove the bark engaged by the rollers.

Figure 8:
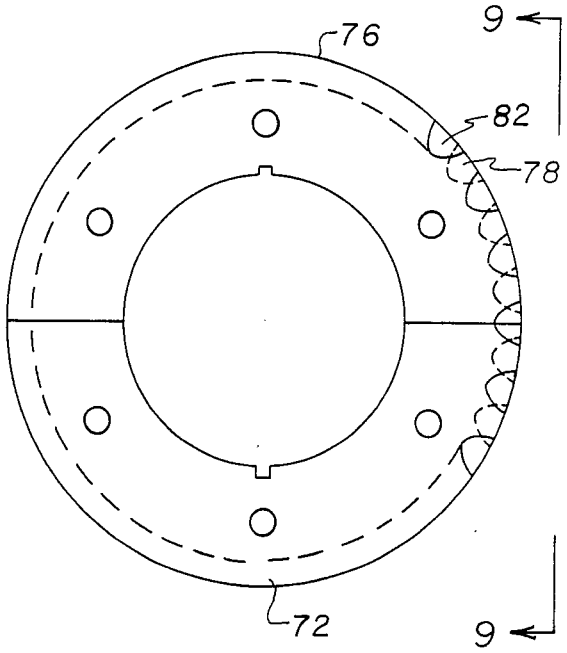
FIG. 8 is an enlarged elevational view of one of the discs used in the drive roller.
Figure 9:
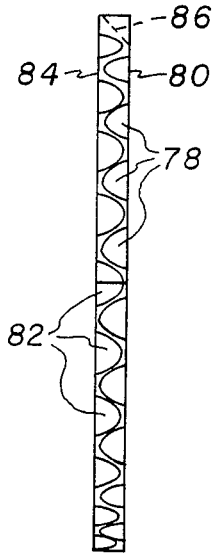
FIG. 9 is a cross-section taken along the line 9—9 of FIG. 8.
Figure 7:
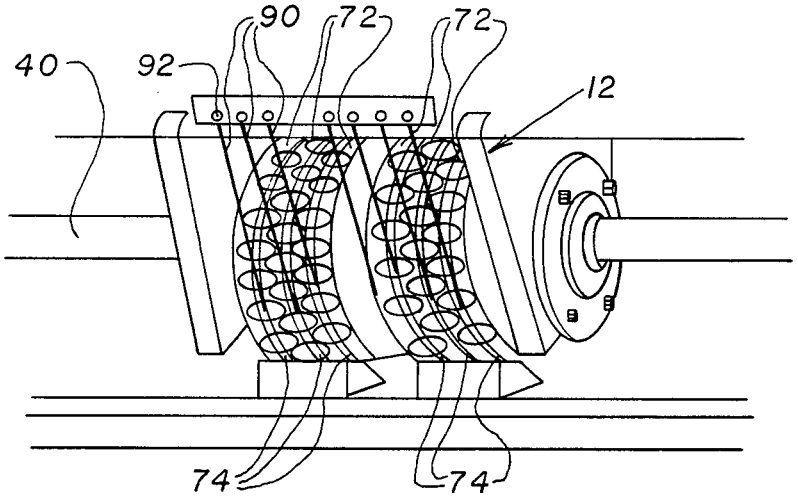
FIG. 7 is a perspective elevational view of one of the self-clenaing drive rollers of the present invention.

Referring now to FIGS. 7–9, the construction of one embodiment of a self-cleaning drive roller such as roller 12, is shown which, while particularly useful for driving and rotating the log 20 in the apparatus 10, is useful in other types of wood handling machines in which round logs or flat surfaced blocks need to be rotated or driven, either transversely or longitudinally. For purposes of illustration only, the top roller 12 is illustrated. Thus, the roller 12 generally includes any suitable number of circular discs 72 here shown as being eight discs 72 secured on the drive shaft 40. The discs 72 are spaced from each other for providing a space 74 between adjacent discs 72. The outer periphery 76 of each disc 72 includes a plurality of openings extending downwardly and outwardly to one side of the disc 72. Preferably, a first plurality of openings 78 extends downwardly and outwardly to a first side 80 of the disc 72 and a second plurality 82 of openings are provided on the outer periphery 76 of the disc 72 extending downwardly and outwardly to a second side 84 of the disc 72. One of the problems of wood driving rollers is that while the drive or peripheral surface may include various configuration for engaging and driving a wooden log, they quickly become clogged up with saw dust, rosin and debris from the wood logs and lose their traction. The configuration of the drive roller 12 allows debris to gather in the openings 78 and 82, but the accumulation will be driven downwardly and outwardly and will not remain packed and clogged in the outer periphery of the disc 72 but will tend to move into the spaces 74 between adjacent discs 72. That is, the base or bottom 86 of each of the openings 78 and 82 is slanted downwardly and outwardly to direct any debris collecting in the openings to one of the side spaces 74. However, eventually the spaces 74 would fill up and prevent the removal of any further debris or clogging in the openings 78 and 82. Therefore, referring now to FIG. 7, a scraper such as a cable 90 is positioned in each of the spaces 74 and is secured at each end 92 on opposite sides of the roller 12 and opposite from the point of driving of the log 20 by the roller 12. Therefore, the cables 90 do not interfere with the driving of the log 20. However, the cables 90 have their ends 92 secured whereby they extend out of the spaces 74 and act to eject any debris picked up by the openings 78 and 82 while in engagement with the logs 20. In addition, the openings 78 and 82 on the periphery 76 of the discs 72 provide a surface which will grip on and engage and drive a log. The remainder of the periphery 76 of the discs 72 are preferably imparted with a heavy knurl for increasing friction drive. Therefore, the rollers provide increased driving capability on irregular surfaces such as wood logs, timbers, and cants, have a self-cleaning profile which sheds debris, and the use of discs 72 allows for easily increasing or decreasing the length of the drive roller.

Figure 11:
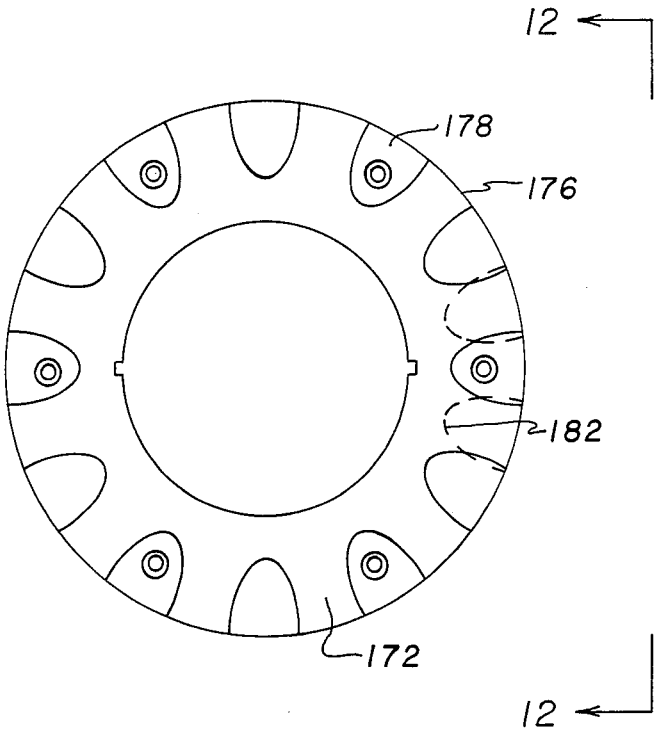
FIG. 11 is an enlarged elevational view of another embodiment of a drive roller.
Figure 12:
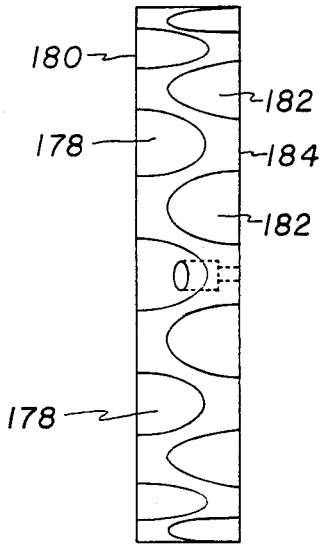
FIG. 12 is a cross-sectional view taken along the line 12—12 of FIG. 11.

Referring now to FIGS. 11 and 12 another embodiment of a self-cleaning roller is best seen. A single disc 172 is used and the outer periphery 176 includes a plurality of large openings extending downwardly and outwardly to each side of the disc 172. A first plurality of openings 178 extend downwardly and outwardly to a first side 180 of the disc 172 and a second plurality 182 of openings are provided on the outer periphery 176 of the disc 172 extend downwardly and outwardly to a second side 184 of the disc 172. The advantage of the larger width disc 172 is that the disc 172 will roll over larger knots, and irregular portions of the logs 20 easier by letting the knots extend into the large openings. However, the discs 172 can be used in multiples and in that case can be provided with scrapers therebetween such as cables.

Figure 10:
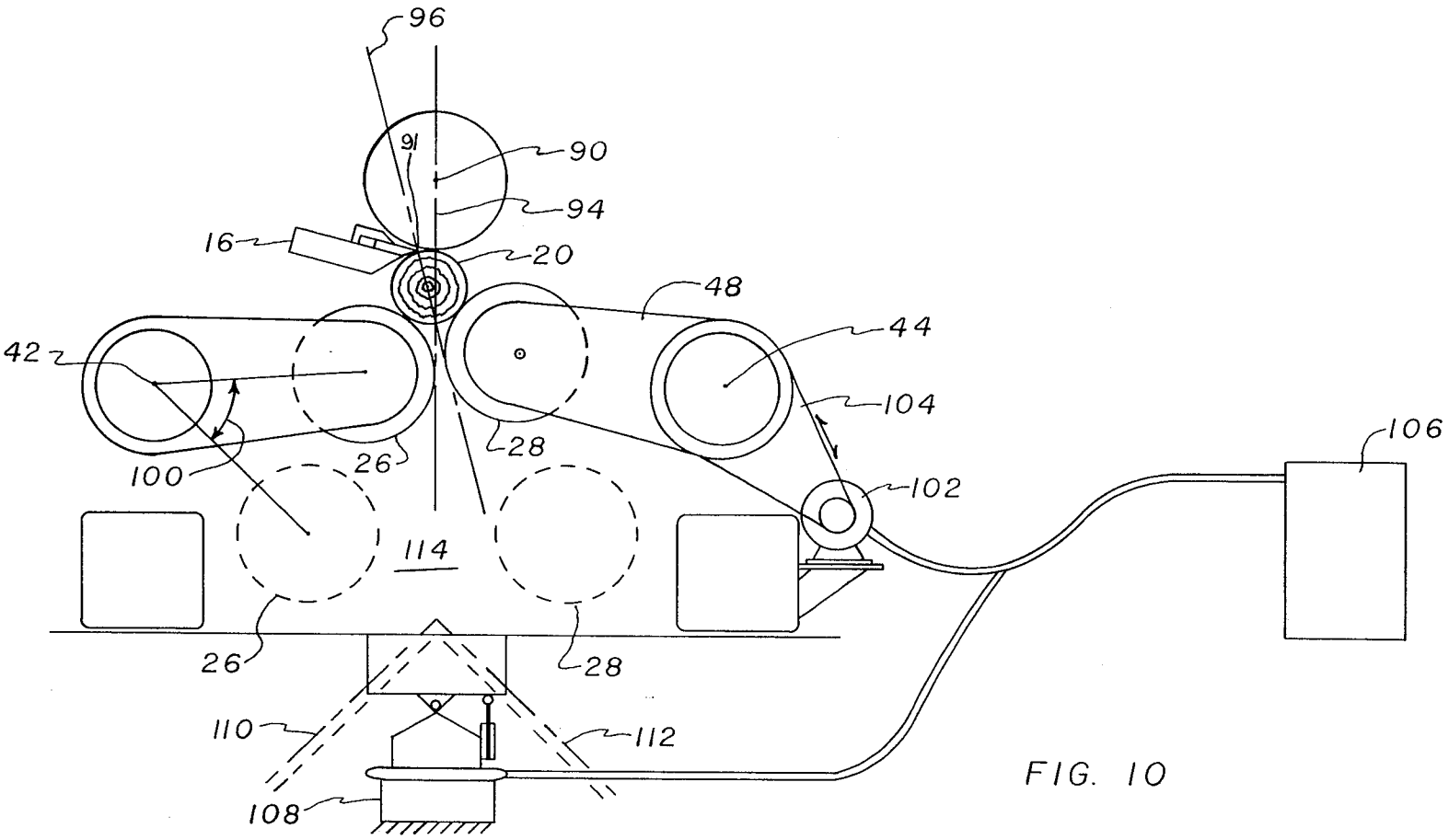
FIG. 10 is a schmatic, elevational view of the diameter measuring and sorting apparatus used with the present invention.

Another feature of the present invention is the placement of the knife 16 relative to the log 20 in order to obtain a maximum yield of the log 20 raw material. Referring now to FIG. 10, if the longitudinal axis of the logs 20, for various diameter logs, all fell in a vertical plane 94 through the longitudinal axis 90 of the top rollers 12 and 14 then, irregardless of the placement of the end 92 of the knife 16, the depth of the cut by the knife 16 would vary depending upon the diameter of the log 20. That is, all of the longitudinal axes of the various size logs 20 would move upwardly in a vertical plane 94 passing through the longitudinal axis 90 of the top rollers 12 and 14. Therefore, if the end 92 of the knife 16 was placed to cut a sufficient amount of circumference off of the small logs 20, then the knife 16 would cut off a greater depth or circumference of the larger logs 20 and would waste raw material. However, as best seen in FIG. 10, the rollers 28 and 24 on the feed side of the apparatus 10 below the feed ramp 30 are preferably positioned at a slightly higher elevation than the rollers 26 and 22 at all corresponding elevational angles. Therefore, the longitudinal axis of various sized logs will all fall in a plane 96 which is offset from the vertical plane 94. If the longitudinal axis of the various sized logs 20 move in the vertical plane 90 then they would only have a common tangent point with each other at the bottom of the upper rollers 12 and 14. However, by offsetting the path of movement of the longitudinal axis of the logs 20 along the plane 96 the common tangent point for various sized diameter logs 20 will be offset from the vertical plane 94. Therefore, by setting the end 92 of the knife 16 at the common tangent point for all diameter size of logs, the same depth of cut will be made on the circumference for all logs, regardless of their diameter size. The depth of cut, while adjustable, is fixed for all sized logs. Therefore, only a predetermined amount of material is removed from each log thereby insuring that the raw material in the log 20 which remains after rounding up the circumference will be a maximum.

Obviously, the diameter sizes of the various logs 20 processed by the apparatus 10 will vary. The use to which the rounded up logs 20 may be utilized depends frequently upon the diameter of the logs 20. Various types of measuring equipment are utilized in wood processing plants to measure the log diameters. The present round up machine is particularly suitable to measure the diameter of the rounded up logs and to group or route the rounded up log or block, according to its diameter. Referring again to FIG. 10, the dotted positions 26 and 28 indicate the lowest most open position for the rollers 26 and 28 for discharging the rounded up logs. The angle 100 therefore, which is the difference from the discharge or fully opened lower roller position and the fully rounded up position of a log 20 is an indication of the diameter of the log 20. The greater the angle 100 the smaller is the diameter of the log 20. Various suitable means may be used to determine the angle 100 and thereafter to sort or route the finished logs 20 in accordance with their diameter size. For example, an electrical encoder 102 or a rotary switch is provided to measure and transmit the magnitude of the angle 100. Thus, a timing belt 104 could be connected to a sprocket about the arm 48 for actuating the encoder 102 which would be a measurement of the angle 100. The encoded information may then be transmitted to a process control panel 106 for utilizing the information which is an indication of the diameter of the log 20. If desired, the information could be processed in the processor 106 and transmitted to a suitable sorter 108 which actuates a first 110 or a second 112 diverter under the log discharge channel 114 to divert the log 20 to one side or the other of the sorter 108.

In use, the apparatus 10 is able to round up full length blocks, debark full length blocks and sort the finished logs by their diameter. Logs are fed into the feed ramp 30 while the lower rollers 22, 24, 26 and 28 are partially retracted to provide a receiving pocket to receive the incoming logs 20 and prevent them from falling out through to the discharge channel 114. After the log 20 is in the pocket, the cylinders 50 and 50*a* are used to raise the lower drive rollers 22, 24, 26 and 28 to bring the log or block 20 into contact with the upper fixed rotatable drive rollers 12 and 14. Rollers 26 and 28 are connected together through a hydraulic shock absorber 60 and rollers 22 and 24 are similarly connected together through a hydraulic shock absorber at the other end of the apparatus 10. In addition, the torsion bar 51 interconnects the rollers 28 and 24. Therefore, all of the rollers are synchronized in timing, but yet are able to accommodate different diameters at the opposite ends of the log 20. As the log 20 is clamped into position between all of the rollers, the bark may be removed by the debarking arms 66 and fingers 70. After this, the knife 16 is moved into position into the tangent point that is common to any diameter log 20. The knife is fixed at the tangent point of various sized logs and removes material, as the rollers are powered to rotate the log 20, that is outside a fixed radius from the longitudinal axis of the log. After the log 20 has been rounded up, the knife 16 is retracted, and the lower rollers 22, 24, 26 and 28 are lowered to a position that allows the log 20 to pass between them into the discharge channel 114. At the same time, the sorting angle 100 has been determined, and the encloder 102 signals the processor 106 which actuates the sorter 108 to route the logs 20 according to their diameter to one or more locations.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. An apparatus for rounding the circumference of a wood log comprising, first and second rotatable rollers adapted to engage the outside of a wood log at two spaced points between the ends of the log, a knife positioned adjacent the first and second rollers and extending the length of the log for cutting off an amount of material from the outer circumference of the log for making the outer circumference of the log more uniformly round, third and fourth movable rollers positioned below the first roller, and movable toward and away from the first roller and each other, fifth and sixth movable rollers positioned below the second roller, and movable toward and away from the second roller and each other, and means for rotating all of said rollers thereby rotating a log positioned between the rollers allowing the knife to cut off predetermined portions of the log extending outwardly for rounding the circumference of the log.

2. The apparatus of claim 1 wherein the third and fourth movable rollers are connected together and move together through a shock absorber, and the fifth and sixth movable rollers are connected together and move together through a shock absorber whereby the spaced rollers can accommodate different diameters at the spaced rollers.

3. The apparatus of claim 1 wherein the third and fifth rollers are connected together by a torsion bar.

4. The apparatus of claim 1 wherein the third and fifth rollers move upwardly a distance towards the first and second rollers, respectively, greater than the fourth and sixth rollers for positioning logs for allowing the apparatus to handle logs of different diameters.

5. The apparatus of claim 1 wherein at least one of the rollers includes, a circular disc including on its outer periphery a plurality of openings extending radially inwardly and outwardly to a side of the disc for shedding debris.

6. The apparatus of claim 1 wherein at least one of the rollers includes, a plurality of rotatable drive discs spaced apart, each disc including on its outer periphery a plurality of openings extending radially inwardly and outwardly to one side of the disc for shedding debris, and a fixed cable positioned between adjacent discs and extending outside of said discs for cleaning debris out from between the discs.

7. The apparatus of claim 1 including, means for measuring the diameter of logs which have been rounded.

8. The apparatus of claim 7 including, means for sorting rounded logs from the apparatus in accordance with their diameter size.

9. The apparatus of claim 1 wherein the knife is positioned at point which is tangent to all diameter logs.

10. The apparatus of claim 1 wherein said the first roller is positioned to engage a log approximately one fourth the length of the log from one end of the log and the second roller is positioned to engage a log approximately one fourth the length of the log from the second end of the log.

11. The apparatus of claim 2 wherein the third and fifth rollers are connected together by a torsion bar.

12. The apparatus of claim 11 wherein the third and fifth rollers move upwardly a distance towards the first and second rollers, respectively, greater than the fourth and sixth rollers for allowing the apparatus for positioning logs for providing maximum yield from different diameter logs.

13. The apparatus of claim 1 including, a plurality of debarking arms positioned to engage and debark a log rotated by said rollers.

14. A self-cleaning wood driving roller comprising, a plurality of rotatable drive discs spaced apart, each disc including on its outer periphery a plurality of openings extending inwardly and outwardly to one side of the disc for shedding debris, and a fixed cable positioned between adjacent discs and extending outside of said discs for cleaning debris out from between the discs.

15. The apparatus of claim 14 wherein the bottom of openings extending downwardly and outwardly.

16. The apparatus of claim 14 wherein one plurality of openings extend inwardly and outwardly to one side of the disc and another plurality of openings extend inwardly and outwardly to the other side of the disc.

17. The apparatus of claim 14 wherein the outer periphery of said discs between the openings is knurled for driving.

* * * * *